US009605634B2

(12) United States Patent
Yoshimaru et al.

(10) Patent No.: US 9,605,634 B2
(45) Date of Patent: Mar. 28, 2017

(54) FUEL INJECTION VALVE

(71) Applicants: DENSO CORPORATION, Kariya, Aichi-pref. (JP); Akira Kamada, Toyota-shi, Aichi-ken (JP); Eiji Murase, Toyota-shi, Aichi-ken (JP); Keisuke Komori, Toyota-shi, Aichi-ken (JP)

(72) Inventors: Kiyotaka Yoshimaru, Obu (JP); Eiji Mimura, Okazaki (JP); Atsuya Okamoto, Okazaki (JP); Akira Kamada, Toyota (JP); Eiji Murase, Nagoya (JP); Keisuke Komori, Toyota (JP)

(73) Assignees: DENSO CORPORATION, Kariya (JP); TOYOTA JIDOSHA KABUSHIKI KAISHA, Toyota (JP)

( * ) Notice: Subject to any disclaimer, the term of this patent is extended or adjusted under 35 U.S.C. 154(b) by 87 days.

(21) Appl. No.: 14/018,871

(22) Filed: Sep. 5, 2013

(65) Prior Publication Data

US 2014/0084087 A1 Mar. 27, 2014

(30) Foreign Application Priority Data

Sep. 26, 2012 (JP) ..... 2012-212024
May 24, 2013 (JP) ..... 2013-109768

(51) Int. Cl.
*F02M 51/06* (2006.01)

(52) U.S. Cl.
CPC ..... *F02M 51/0614* (2013.01); *F02M 51/061* (2013.01); *F02M 51/066* (2013.01)

(58) Field of Classification Search
CPC ..... B05B 1/30; F02M 51/00; F02M 51/06; F02M 51/0614; F02M 51/061; F02M 51/066
USPC ..... 239/585.3, 585.4, 533.2, 586, 581.1, 239/585.5, 533.9, 533.12, 584.3, 584.4, 239/585.1
See application file for complete search history.

(56) References Cited

U.S. PATENT DOCUMENTS

| | | | | |
|---|---|---|---|---|
| 6,062,531 | A * | 5/2000 | Rapp et al. | 251/50 |
| 7,690,587 | B2 * | 4/2010 | Cooke | 239/102.2 |
| 7,753,337 | B2 | 7/2010 | Suzuki et al. | |
| 7,896,262 | B2 * | 3/2011 | Suzuki et al. | 239/584 |
| 2003/0047626 | A1 | 3/2003 | Maier et al. | |
| 2004/0256494 | A1 * | 12/2004 | Varble et al. | 239/533.2 |

(Continued)

FOREIGN PATENT DOCUMENTS

JP 2004-505205 2/2004

*Primary Examiner* — Arthur O Hall
*Assistant Examiner* — Christopher R Dandridge
(74) *Attorney, Agent, or Firm* — Nixon & Vanderhye P.C.

(57) ABSTRACT

A needle has a large-diameter portion, an outer diameter of which is larger than that of a shaft portion of the needle. A needle-side tapered surface is formed at the large-diameter portion on a valve closing side thereof, wherein the needle-side tapered surface is inclined by a needle angle with respect to a center axis of the needle. A core-side tapered surface is formed at a movable core, wherein the core-side tapered surface is inclined by a core angle with respect to the center axis of the needle. The needle and the movable core are brought into contact with each other via the needle-side and the core-side tapered surfaces. The needle angle and the core angle are made to be equal to each other.

7 Claims, 6 Drawing Sheets

(56) References Cited

U.S. PATENT DOCUMENTS

| | | | | |
|---|---|---|---|---|
| 2007/0261673 | A1* | 11/2007 | Rueckle | F02M 47/027 123/445 |
| 2009/0320801 | A1* | 12/2009 | Ricco et al. | 123/472 |
| 2010/0065021 | A1* | 3/2010 | Hayatani et al. | 123/476 |
| 2011/0057059 | A1* | 3/2011 | Yamamoto | F02M 51/0675 239/584 |
| 2012/0080542 | A1* | 4/2012 | Imai | F02M 51/0671 239/533.2 |

* cited by examiner

FUEL INJECTION VALVE

CROSS REFERENCE TO RELATED APPLICATION

This application is based on Japanese Patent Application No. 2012-212024 filed on Sep. 26, 2012 and No. 2013-109768 filed on May 24, 2013, the disclosures of which are incorporated herein by reference.

FIELD OF TECHNOLOGY

The present disclosure relates to a fuel injection valve for injecting fuel into a combustion chamber of an internal combustion engine (hereinafter, the engine).

BACKGROUND

A fuel injection valve is known in the art, for example, as disclosed in Japanese Patent Publication No. 2007-278218, according to which each of a movable core and a needle is respectively formed as an independent part and the movable core is arranged to be movable relative to the needle. The fuel injection valve of the above prior art has a first elastic member for biasing the movable core and the needle in a direction to a fuel injection port and a second elastic member for biasing the movable core in a direction opposite to the fuel injection port.

According to the above prior art, the needle and the movable core are brought into contact with each other in an axial direction, wherein each of contacting surfaces (that is, a needle-side stepped surface and a core-side stepped surface) is formed as a flat surface perpendicular to a center axis of the needle. When the needle moves relative to the movable core in a horizontal direction (a direction perpendicular to the center axis of the needle) due to vibration of the engine, the needle-side and the core-side stepped surfaces may be worn away. As a result, the contacting surfaces may be damaged.

SUMMARY OF THE DISCLOSURE

The present disclosure is made in view of the above problem. It is an object of the present disclosure to provide a fuel injection valve, in which a needle and a movable core are formed as independent parts from each other but wear volume of the needle and the movable core can be reduced.

According to a feature of the present disclosure, a fuel injection valve has; a housing having an injection port and a valve seat; a needle movably accommodated in the housing and having a shaft portion of a cylindrical rod shape and a large-diameter portion with an outer diameter larger than that of the shaft portion; and a movable core formed as an independent part from the needle and movably accommodated in the housing so as to reciprocate in an axial direction together with the needle. The needle has a needle-side tapered surface inclined by a needle angle with respect to a center axis of the needle, while the movable core has a core-side tapered surface inclined by a core angle with respect to the center axis of the needle, wherein the needle angle and the core angle are identical to each other.

According to the fuel injection valve of the present disclosure, the needle and the movable core are formed as independent parts from each other. When the fuel injection valve vibrates due to vibration of an engine, the needle and the movable core are relatively displaced from each other. According to the fuel injection valve of the present disclosure, the needle and the movable core are brought into contact with each other via the needle-side tapered surface and the core-side tapered surface, each of which is inclined by the same angle with respect to the center axis of the needle. As a result, the relative movement of the needle with respect to the movable core, in particular, the relative movement in a radial direction, is restricted. Wear volume of the needle and the movable core can be reduced, even though the needle and the movable core are formed as the independent parts from each other.

According to the fuel injection valve of the prior art, the needle and the movable core are in contact with each other via a needle-side flat surface and a core-side flat surface, each of which is perpendicular to a center axis of the needle. According to the fuel injection valve of the present disclosure, the contacting surfaces (the needle-side and the core-side tapered surfaces) are inclined with respect to the center axis of the needle. A contacting surface area between the needle and the movable core of the present disclosure becomes larger than that of the prior art. As a result, surface pressure applied at the needle-side and the core-side tapered surfaces becomes smaller, so that the wear volume of the needle and the movable core can be reduced.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION OF THE EMBODIMENTS

The present disclosure will be explained by way of multiple embodiments and modifications with reference to the drawings.

First Embodiment

Figure 1:
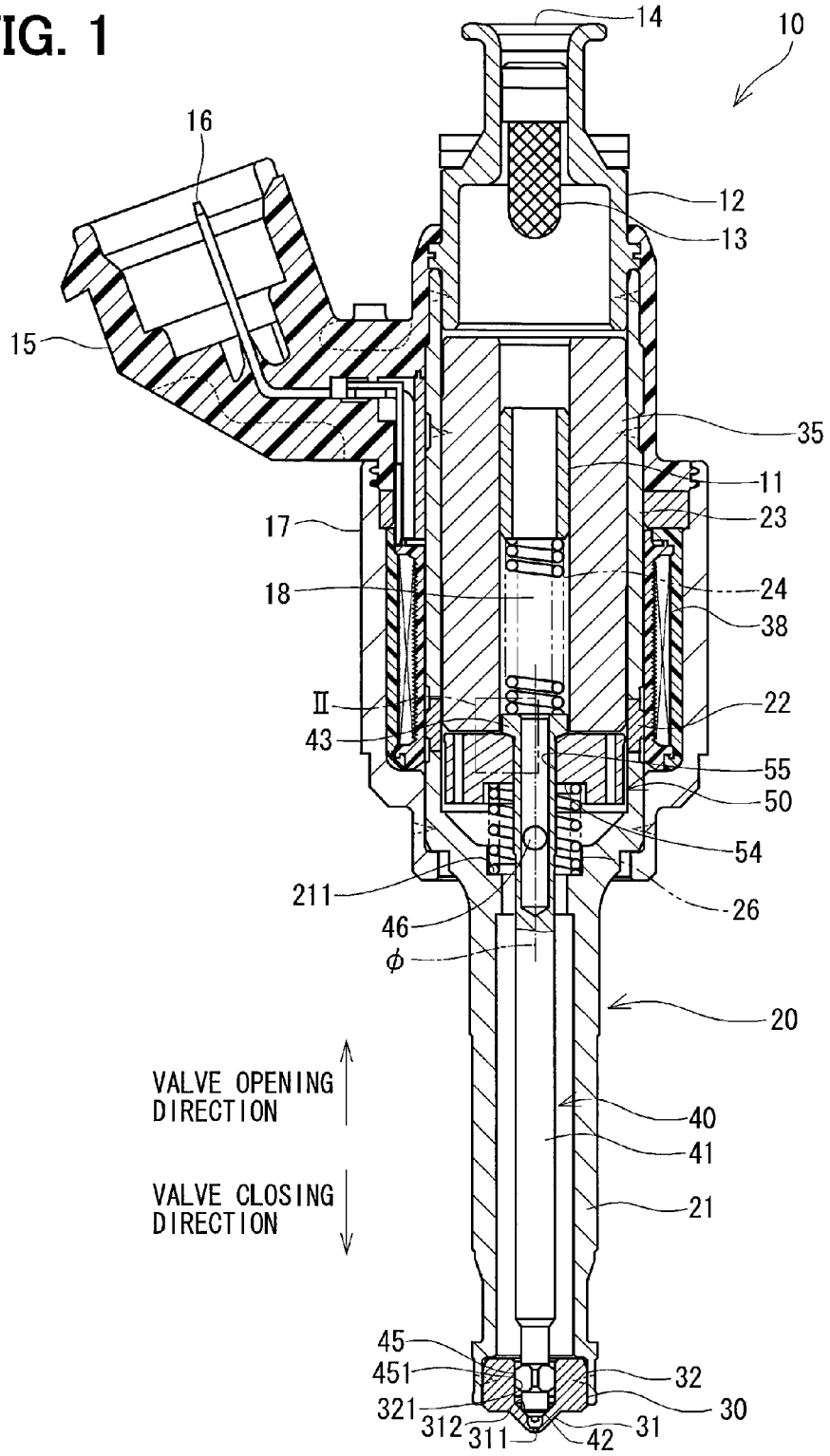
FIG. 1 is a schematic cross sectional view showing a fuel injection valve according to a first embodiment of the present disclosure.
Figure 2:
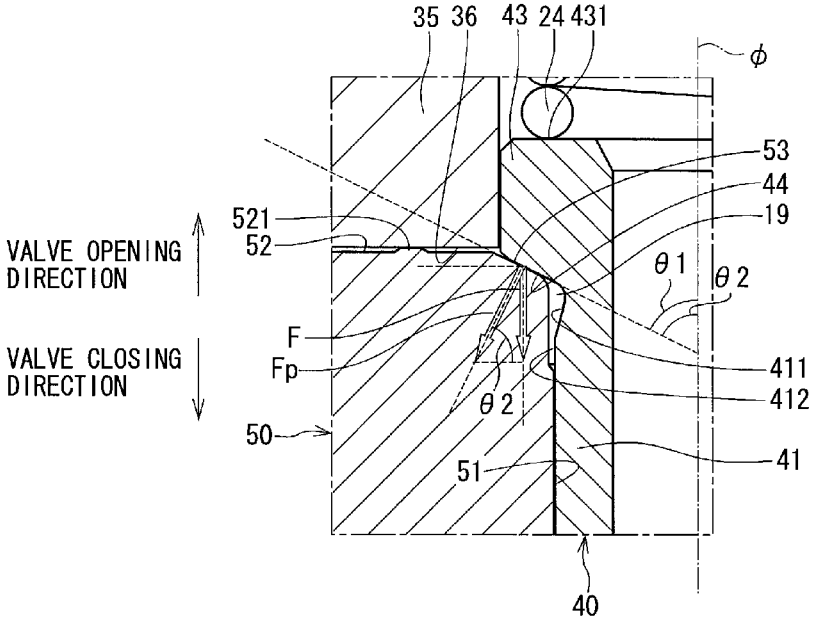
FIG. 2 is a schematic enlarged view of a portion II of the fuel injection valve of FIG. 1.

A fuel injection valve 10 of the first embodiment is shown in FIGS. 1 and 2. In FIGS. 1 and 2, a valve opening direction in which a needle 40 is separated from a valve seat 312 and a valve closing direction in which the needle 40 is moved toward the valve seat 312 are respectively indicated by arrows.

The fuel injection valve 10 is applied to, for example, a fuel injection apparatus for a direct-injection type gasoline engine (not shown), in order to inject fuel (gasoline) into respective cylinders of the engine. The fuel injection valve 10 is composed of a housing 20, the needle 40, a movable core 50, a fixed core 35, a solenoid coil 38, springs 24 and 26 and so on.

As shown in FIG. 1, the housing 20 is composed of a first cylindrical member 21, a second cylindrical member 22, a third cylindrical member 23 and an injection nozzle 30. Each of the first to the third cylindrical members 21, 22 and 23 is formed in an almost cylindrical shape. The first to the third cylindrical members 21, 22 and 23 are coaxially connected to one another in this order.

The first and third cylindrical members 21 and 23 are made of magnetic material, such as ferritic stainless steel and treated with a magnetic stabilization process. Hardness of the first and third cylindrical members 21 and 23 is relatively small. On the other hand, the second cylindrical member 22 is made of non-magnetic material, such as austenitic stainless steel. Hardness of the second cylindrical member 22 is higher than that of first and third cylindrical members 21 and 23.

The injection nozzle 30 is provided at a lower end of the first cylindrical member 21 opposite to the second cylindrical member 22. The injection nozzle 30 is made of metal, such as martensitic stainless steel. The injection nozzle 30 is subjected to quenching treatment so as to have certain hardness.

The injection nozzle 30 is formed in a cylindrical shape having a bottom portion 31 and a cylindrical portion 32. The bottom portion 31 closes one end of the cylindrical portion 32. An injection port 311 is formed in the bottom portion 31 so as to communicate an inside and an outside of the injection nozzle 30. The valve seat 312 of an annular shape is formed at an inner wall of the bottom portion 31 so as to surround the injection port 311. An outer wall of the cylindrical portion 32 is fitted into a bore formed by an inner wall of the first cylindrical member 21, so that the injection nozzle 30 is fixed to the first cylindrical member 21. Fitting portions of the cylindrical portion 32 and the first cylindrical member 21 are welded to each other.

The needle 40 is made of metal, such as martensitic stainless steel. The needle 40 is subjected to quenching treatment so as to have certain hardness. The hardness of the needle 40 is almost equal to that of the injection nozzle 30.

The needle 40 is accommodated in the housing 20. The needle 40 has a shaft portion 41, a sealing portion 42, a large-diameter portion 43 and so on, which are integrally formed with one another.

The shaft portion 41 is formed in a cylindrical rod shape. A sliding portion 45 is formed at a lower portion of the shaft portion 41, which is close to the sealing portion 42. The sliding portion 45 is formed in an almost cylindrical shape. Some portions of an outer wall 451 of the sliding portion 45 are chamfered so as to cut the portions away. The remaining portions of the outer wall 451, which are not chamfered, are in a sliding contact with an inner wall 321 of the cylindrical portion 32 of the injection nozzle 30. The needle 40 is thereby guided in a reciprocating manner at its forward end side by the inner wall 321 of the injection nozzle 30. A bore 46 is formed at an upper portion of the shaft portion 41 in order to communicate an inside and an outside of the shaft portion 41 with each other.

The sealing portion 42 is formed at an axial forward end of the shaft portion 41, which is on a side of the valve seat 312. The sealing portion 42 is brought into contact with the valve seat 312 or separated therefrom, so that the needle 40 closes or opens the injection port 311. An inside of the housing 20 is thereby communicated to an outside of the fuel injection valve 10 or the communication between the inside and the outside of the fuel injection valve 10 is blocked off.

The large-diameter portion 43 is formed at an axial upper end of the shaft portion 41, which is on an opposite side of the sealing portion 42. An outer diameter of the large-diameter portion 43 is larger than that of the shaft portion 41. As shown in FIG. 2, a needle-side tapered surface 44 is formed at an axial end of the large-diameter portion 43, which is on a valve closing side. The needle-side tapered surface 44 is inclined by a needle angle "θ1" with respect to a center axis "φ" of the needle 40 (which corresponds to the center axis of the shaft portion 41), wherein the needle angle "θ1" is smaller than 90°.

In the first embodiment, the needle angle "θ1" is between 45° and 85°, both inclusive.

A recessed portion 411 is formed at a portion of an outer wall 412 of the shaft portion 41, which is close to the large-diameter portion 43. An outer diameter of the recessed portion 411 is smaller than that of the shaft portion 41, at which the recessed portion 411 is not formed. A damping chamber 19 is formed between the outer wall 412 of the recessed portion 411 and an inner wall 51 of the movable core 50 (hereinafter, the core-side inner wall 51). The outer wall 412 and the core-side inner wall 51 are opposing to each other in a radial direction. Fuel can flow into and/or flow out from the damping chamber 19. The recessed portion 411 is also referred to as "a needle-side recessed portion". A recessed portion (a core-side recessed portion) is also formed at the inner wall 51 of the movable core 50 to form the damping chamber 19. However, the core-side recessed portion at the inner wall 51 is not always necessary.

In the present embodiment, the lower end of the needle 40 (that is, the sliding portion 45) is movably supported by the inner wall of the injection nozzle 30, while the upper end of the needle 40 (that is, an upper portion of the shaft portion 41) is movably supported by an inner wall of the second cylindrical member 22 via the movable core 50, so that the needle 40 reciprocates in the inside of the housing 20.

The movable core 50 is made of magnetic material, for example, ferritic stainless steel, and formed in an almost cylindrical shape. An outer surface of the movable core 50 is chrome-plated. The movable core 50 is subjected to magnetic stabilization treatment. Hardness of the movable core 50 is relatively small and almost equal to that of the first and third cylindrical members 21 and 23 of the housing 20.

The movable core 50 has the core-side inner wall 51, a core-side upper surface 52, a core-side tapered surface 53 and so on. The core-side inner wall 51 forms a through-hole 55, through which the shaft portion 41 of the needle 40 is movably inserted. The core-side tapered surface 53 is formed on an upper-side surface of the movable core 50, which is on a side of the fixed core 35 and around a periphery of the through-hole 55. The core-side tapered surface 53 is formed between the core-side inner wall 51 and the core-side upper surface 52, so that the core-side tapered surface 53 is respectively connected to the core-side inner wall 51 and the core-side upper surface 52.

As shown in FIG. 2, the core-side tapered surface 53 is inclined by a core angle "θ2" with respect to the center axis "ϕ" of the needle 40, wherein the core angle "θ2" is identical to the needle angle "θ1" of the needle-side tapered surface 44. The core-side tapered surface 53 is in contact with the needle-side tapered surface 44. The core-side tapered surface 53 can be separated from the needle-side tapered surface 44. The core angle "θ2" is also between 45° and 85°, both inclusive.

A projection 521 is formed on the core-side upper surface 52 in order to prevent adhesion between the core-side upper surface 52 and a lower surface 36 of the fixed core 35, when the core-side upper surface 52 is brought into contact with the lower surface 36 of the fixed core 35 (The lower surface 36 is formed on the surface of the fixed core 35, which is on a side of the valve seat 312).

The fixed core 35 is made of magnetic material, for example, ferritic stainless steel, and formed in an almost cylindrical shape. The fixed core 35 is subjected to magnetic stabilization treatment. Hardness of the fixed core 35 is relatively small and almost equal to that of the movable core 50. The fixed core 35 is arranged in the inside of the housing 20. The fixed core 35 and the third cylindrical member 23 of the housing 20 are welded to each other.

The solenoid coil 38 is formed in an almost cylindrical shape and so arranged as to surround radial outward walls of the second and third cylindrical members 22 and 23 of the housing 20. The solenoid coil 38 generates magnetic force when electric power is supplied thereto. When the magnetic force is generated, magnetic circuit is formed in the fixed core 35, the movable core 50, the first cylindrical member 21 and the third cylindrical member 23. A magnetic attracting force is thereby formed between the fixed core 35 and the movable core 50, so that the movable core 50 is attracted to the fixed core 35. Since the core-side tapered surface 53 of the movable core 50 and the needle-side tapered surface 44 of the needle 40 are in contact with each other, the needle 40 is moved toward the fixed core 35 together with the movable core 50. Namely, the needle 40 is lifted up in the valve opening direction.

The spring 24 is so arranged that one end of the spring 24 (that is, a lower end thereof) is in contact with a spring-contact surface 431 of the large-diameter portion 43. The other end of the spring 24 (an upper end thereof) is in contact with a lower end of an adjusting pipe 11, which is press inserted into an inside of the fixed core 35. The spring 24 is also referred to as "a first biasing member". The spring 24 exerts a biasing force expanding in an axial direction to the needle 40, in order to bias the needle 40 in the valve closing direction, that is, in a direction toward the valve seat 312.

The spring 26 is so arranged in the housing 20 that one end of the spring 26 (an upper end thereof) is in contact with an annular recessed surface 54 of the movable core 50, which is formed at a lower-side surface of the movable core 50. The other end of the spring 26 (a lower end thereof) is in contact with an annular recessed surface 211 of the housing 20, which is formed at an upper-side surface of the first cylindrical member 21. The spring 26 is also referred to as "a second biasing member". The spring 26 exerts a biasing force expanding in the axial direction to the movable core 50, in order to bias the movable core 50 and the needle 40 in the valve opening direction, that is, in a direction opposite to the valve seat 312.

In the present embodiment, the biasing force of the spring 24 is larger than that of the spring 26, so that the sealing portion 42 of the needle 40 is seated on the valve seat 312, when no electric power is supplied to the solenoid coil 38. As a result, the needle 40 closes the injection port 311. In other words, the fuel injection valve 10 is in the valve closed condition.

As shown in FIG. 1, a fuel inlet pipe 12 of a cylindrical shape is press-inserted into one end of the third cylindrical member 23, which is on a side opposite to the second cylindrical member 22, that is, an upper end of the third cylindrical member 23. The fuel inlet pipe 12 is welded to the third cylindrical member 23. A filter 13 is arranged in an inside of the fuel inlet pipe 12 in order to collect extraneous material contained in the fuel flowing into the fuel inlet pipe 12 from a fuel inlet port 14.

A radial outward portion of the fuel inlet pipe 12 as well as a radial outward portion of the third cylindrical member 23 is molded with and covered by resin. A connector 15 is formed in such a molded body. A terminal 16 is insert-molded in the connector 15 in order to supply the electric power to the solenoid coil 38. A cylindrical holder 17 is provided at a radial outward side of the solenoid coil 38 so as to cover the same.

The fuel flows from the fuel inlet port 14 of the fuel inlet pipe 12 into the inside of the fuel injection valve 10 and passes through inside spaces of the fixed core 35, the adjusting pipe 11, an inside of the shaft portion 41 of the needle 40, the bore 46, and a space between the first cylindrical member 21 and the needle 40 as well as a space between the injection nozzle 30 and the needle 40. The fuel finally reaches at the injection port 311. As above, the inside spaces of the housing 20 form a fuel passage 18, through which the fuel passes. When the fuel injection valve 10 is in its operation, the space around the movable core 50 is filled with the fuel.

An operation of the fuel injection valve 10 will be explained. When the electric power is supplied to the solenoid coil 38, the electromagnetic attracting force is generated between the fixed core 35 and the movable core 50. Then, a sum of the biasing force of the spring 26 and the electromagnetic force becomes larger than the biasing force of the spring 24, so that the movable core 50 is moved to the fixed core 35. The needle 40 is lifted up together with the movable core 50 toward the fixed core 35 and the sealing portion 42 is separated from the valve seat 312. As a result, the fuel injection valve 10 is in the valve opened condition. Therefore, the fuel, which flows into the fuel injection valve 10 from the fuel inlet port 14 of the fuel inlet pipe 12, passes through the fuel passage 18 and is injected from the injection port 311 to the outside of the fuel injection valve (that is, the combustion chamber of the engine).

When the movable core 50 is attracted by the solenoid coil 38 so as to move toward the fixed core 35, the movable core 50 comes into collision with the fixed core 35. Then, the movement of the movable core 50 in the valve opening direction is restricted. When the movable core 50 comes into collision with the fixed core 35, the large-diameter portion 43 is overshot in the valve opening direction against the biasing force of the spring 24 due to the inertia of the needle 40. Since volume of the damping chamber 19 is increased due to the overshoot of the large-diameter portion 43 (an upward movement of the large-diameter portion 43 relative to the movable core 50), the fuel in the space between the core-side upper surface 52 of the movable core 50 and the lower surface 36 of the fixed core 35 flows into the damping chamber 19 through a space between the needle-side tapered surface 44 and the core-side tapered surface 53. Thus, an excessive overshoot of the large-diameter portion 43 in the valve opening direction is suppressed by a damping effect, which occurs when the large-diameter portion 43 is separated from the movable core 50.

After the large-diameter portion 43 is overshot, the needle 40 is moved in the valve closing direction (that is, the direction toward the valve seat 312) by the biasing force of the spring 24. During the downward movement of the needle 40 relative to the movable core 50, the volume of the damping chamber 19 is reduced. Therefore, the fuel of the damping chamber 19 flows out to the space between the core-side upper surface 52 of the movable core 50 and the lower surface 36 of the fixed core 35. Because of the damping effect, the large-diameter portion 43 of the needle 40 is prevented from clashing with the movable core 50. Then, the large-diameter portion 43 is brought into contact with the movable core 50 and the needle 40 is kept in contact with the movable core 50 during the fuel injection valve 10 is in the valve opened condition.

When the supply of the electric power to the solenoid coil 38 is cut off, the electromagnetic attracting force between the movable core 50 and the fixed core 35 disappears. Then, the movable core 50 is moved in the valve closing direction by the biasing force of the spring 24 together with the needle 40. When the sealing portion 42 of the needle 40 is seated on the valve seat 312, the fuel injection from the fuel injection valve 10 is blocked off.

The movable core 50 is undershot in the valve closing direction against the biasing force of the spring 26 due to the inertia of its movement toward the valve seat 312. Since the volume of the damping chamber 19 is increased due to the undershoot of the movable core 50 (the downward movement of the movable core 50 relative to the needle 40), the fuel in the space between the core-side upper surface 52 of the movable core 50 and the lower surface 36 of the fixed core 35 flows into the damping chamber 19 through the space between the needle-side tapered surface 44 and the core-side tapered surface 53. As a result, an excessive undershoot of the movable core 50 in the valve closing direction is suppressed by the damping effect, which occurs when the movable core 50 is separated from the large-diameter portion 43.

After the movable core 50 is undershot, the movable core 50 is moved in the valve opening direction (that is, the direction toward the fixed core 35) by the biasing force of the spring 26. During the upward movement of the movable core 50 relative to the large-diameter portion 43, the volume of the damping chamber 19 is reduced. As a result, the fuel of the damping chamber 19 flows out to the space between the core-side upper surface 52 of the movable core 50 and the lower surface 36 of the fixed core 35. Because of the damping effect, the movable core 50 is prevented from clashing with the large-diameter portion 43 of the needle 40. Then, the movable core 50 is brought into contact with the large-diameter portion 43 and the movable core 50 is kept in contact with the needle 40 during the fuel injection valve 10 is in the valve closed condition.

In the fuel injection valve 10, the needle 40 and the movable core 50 are kept in a contacted condition except for an initial stage of a valve opening process and an initial stage of a valve closing process. In the initial stage of the valve opening process, the needle 40 is overshot. In the initial stage of the valve closing process, the movable core 50 is undershot. Various kinds of relative movements may occur between the needle 40 and the movable core 50 due to vibration of the engine, pulsation of fuel pressure in the fuel injection valve 10 and so on. In the present embodiment, the needle 40 and the movable core 50 are in contact with each other via the needle-side tapered surface 44 and the core-side tapered surface 53. As already explained above, the needle-side tapered surface 44 is inclined by the needle angle "θ1" with respect to the center axis "ϕ", while the core-side tapered surface 53 is inclined by the core angle "θ2" with respect to the center axis "ϕ". The movement of the needle 40, which may take place because of the various kinds of the relative movement between the needle 40 and the movable core 50, is restricted by the above structure (the contact via the tapered surfaces). Since the movement of the needle 40 with respect to the movable core 50 is restricted, frequency of rubbing between the needle-side tapered surface 44 and the core-side tapered surface 53 can be reduced. As a result, the wear volume of the needle 40 and the movable core 50 can be reduced.

In the present embodiment, each of the needle angle "θ1" and the core angle "θ2" is designed to be equal to or smaller than "85°". The inventors of the present disclosure found out that there existed a certain relationship between the wear volume and the needle angle as well as the core angle. Effects for reducing the wear volume of the needle 40 and the movable core 50 will be explained with reference to FIGS. 3 to 5.

In a case that two elements are in contact with each other, wear volume of a contacting portion is generally in proportion to a product of "moving distance" and "surface pressure" between the two contacting elements. The "moving distance" is an amount of relative displacement between the two contacting elements. In the present embodiment, a slipping amount of the needle 40 relative to the movable core 50 corresponds to the "moving distance". The "surface pressure" is an acting force applied per unit of area, wherein the acting force is applied from a surface of one element to a surface of the other element in a direction perpendicular to the surface of the other element.

In the present embodiment, in FIG. 2, "F" is an acting force applied in the valve closing direction from the needle-side tapered surface 44 to the core-side tapered surface 53. "Fp" is a surface pressure based on the acting force "F". When the surface pressure "Fp" is divided into components, that is, a component in the valve closing direction and a component in a direction perpendicular to the valve closing direction, the acting force "F" corresponds to the component of the surface pressure "Fp" in the valve closing direction. As shown in FIG. 2, the surface pressure "Fp" is expressed by "$Fp=F/\sin(\theta 2)$". The acting force "F" can be obtained based on the biasing forces of the springs 24 and 26, weight of the needle 40 and so on.

Figure 3:
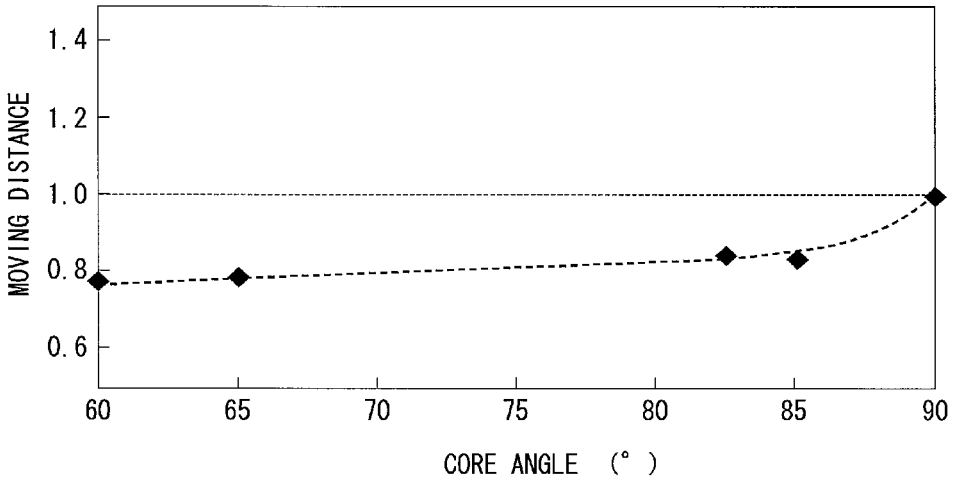
FIG. 3 is a diagram showing a characteristic curve of a moving distance of a needle with respect to a core angle according to the first embodiment.

As shown in FIG. 3, the inventors of the present disclosure have confirmed based on experiments that the relative moving distance of the needle 40 with respect to the movable core 50 becomes smaller as the core angle becomes smaller (less than 90°). In FIG. 3, the moving distance in case of the core angle being 90° is set as "1". The moving distance in case of the other core angles is calculated as a relative figure with respect to the moving distance in case of the core angle of 90°.

Figure 4:
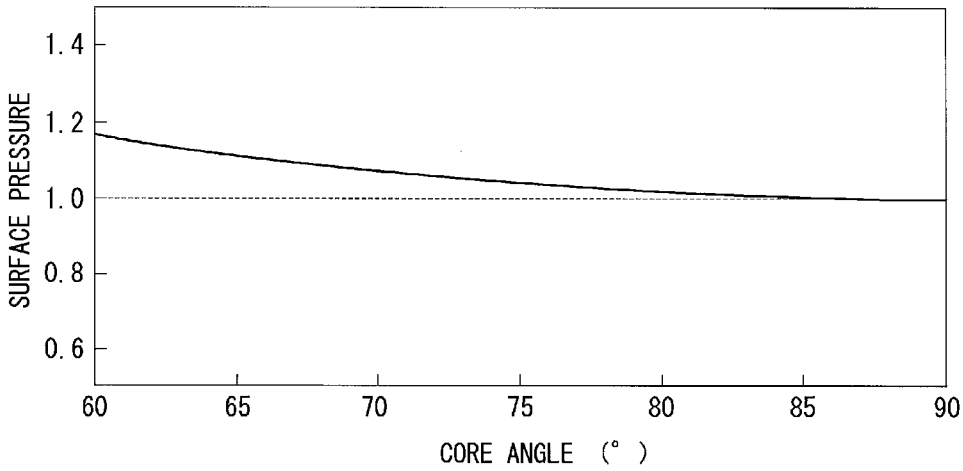
FIG. 4 is a diagram showing a characteristic curve of surface pressure between the needle and a movable core with respect to the core angle according to the first embodiment.

As shown in FIG. 4, the inventors of the present disclosure have likewise confirmed that the surface pressure applied from the needle 40 to the movable core 50 becomes larger as the core angle becomes smaller (less than 90°). In FIG. 4, the surface pressure in case of the core angle being 90° is set as "1". The surface pressure in case of the other core angles is calculated as a relative figure with respect to the surface pressure in case of the core angle of 90°.

Figure 5:
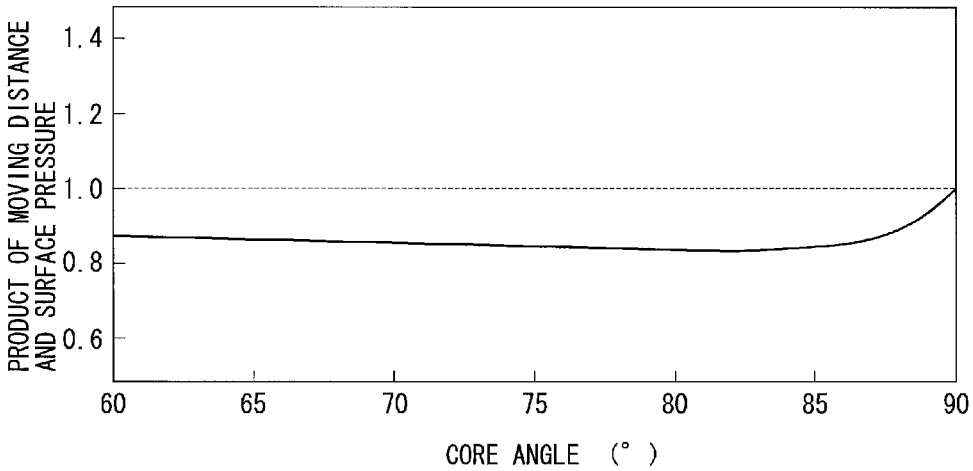
FIG. 5 is a diagram showing a characteristic curve of a product of the moving distance of the needle and the surface pressure, with respect to the core angle according to the first embodiment.

FIG. 5 shows a relationship of a product of "the moving distance" and "the surface pressure" with respect to the core angle. "The moving distance" corresponds to the moving distance of the needle 40 relative to the movable core 50, wherein the moving distance is obtained based on measurement in actual experiments. "The surface pressure" corresponds to the surface pressure, which is applied from the needle 40 to the movable core 50 and obtained by calculation. In FIG. 5, a horizontal axis shows the core angle, while a vertical axis shows the product of the moving distance and the surface pressure, wherein the product is in proportion to the wear volume of the needle 40 and the movable core 50. As shown in FIG. 5, the product of the moving distance and the surface pressure becomes smaller, as the core angle becomes smaller than 90°. In particular, at the core angle of 85°, the product of the moving distance and the surface pressure is minimized. The wear volume of the needle and the movable core can be minimized at the core angle of 85°.

As shown in FIG. 5, in the fuel injection valve 10, in which the needle angle "θ1" and the core angle "θ2" is equal to or smaller than 85°, the wear volume of the needle 40 and the movable core 50 can be reduced.

In the fuel injection valve 10 of the present embodiment, each of the needle angle "θ1" and the core angle "θ2" is designed to be equal to or larger than 45°. The needle 40 is prevented from being press inserted into the through-hole 55 of the movable core 50 due to the relative movement between the needle 40 and the movable core 50.

In the fuel injection valve of the prior art, the needle and the movable core are in contact with each other via the respective contacting surfaces, each of which is perpendicular to the center axis of the needle. A contacting surface area in the fuel injection valve of the prior art is at most such a value, which is obtained by subtracting a cross-sectional area of the shaft portion from a cross-sectional area of the large-diameter portion.

In the fuel injection valve of the present embodiment, the needle 40 and the movable core 50 are in contact with each other via the needle-side tapered surface 44 and the core-side tapered surface 53. Each of the needle-side and the core-side tapered surfaces 44 and 53 is inclined with respect to the center axis "ϕ" of the needle 40. Therefore, the contacting surface area between the needle 40 and the movable core 50 becomes larger than the above value, which is obtained by subtracting the cross-sectional area of the shaft portion from the cross-sectional area of the large-diameter portion. In other words, even in the case that the large-diameter portion 43 of the present embodiment has the same size to that of the prior art, the needle 40 and the movable core 50 of the present embodiment can be in contact with each other via the contacting surfaces having larger contacting areas (tapered surfaces) than that of the prior art. As a result, the surface pressure in the needle-side and the core-side tapered surfaces 44 and 53 of the present embodiment can be made smaller, to thereby reduce the wear volume of the needle 40 and the movable core 50.

In the initial stage of the valve opening process, in which the needle 40 is overshot, as well as in the initial stage of the valve closing process, in which the movable core 50 is undershot, the fuel flows into or flows out from the damping chamber 19 through the space between the needle-side tapered surface 44 and the core-side tapered surface 53. When a flow distance of the space between the tapered surfaces 44 and 53 becomes longer, the fuel more hardly flows into or flows out from the damping chamber 19. As a result, the damping effect of the present embodiment during the valve opening or the valve closing process becomes larger than that of the prior art.

Second Embodiment

A fuel injection valve of a second embodiment will be explained with reference to FIG. 6. A relationship of the contacting surface area between the needle-side tapered surface and the core-side tapered surface of the second embodiment is different from that of the first embodiment. The same reference numerals are given to those parts, which are the same or similar to those of the first embodiment.

Figure 6:
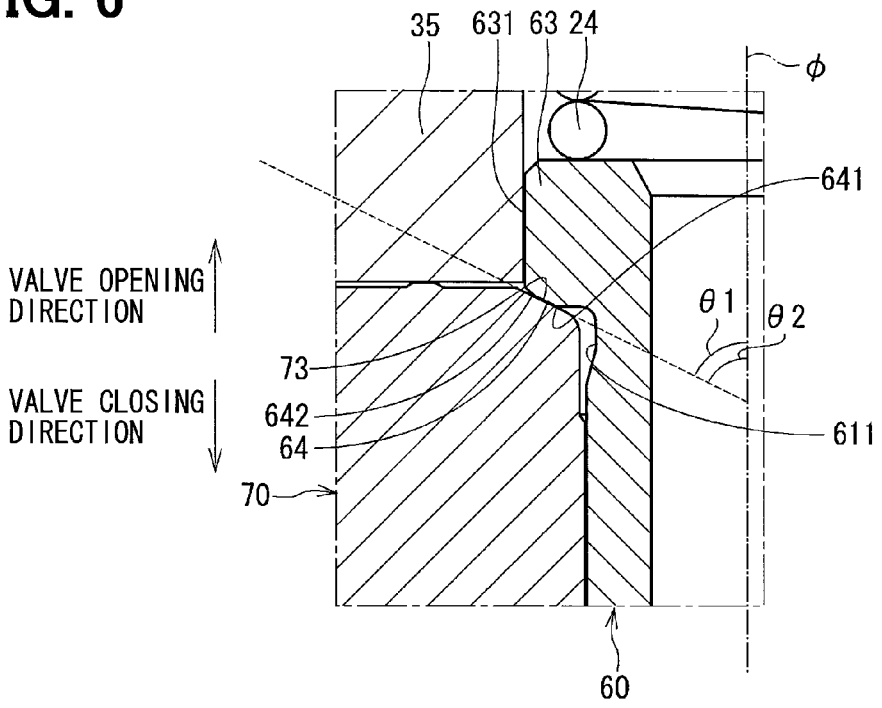
FIG. 6 is a schematic enlarged view showing a relevant portion of a fuel injection valve according to a second embodiment of the present disclosure.

FIG. 6 is a cross-sectional view schematically showing a contacted condition of a needle 60 and a movable core 70 of the fuel injection valve of the second embodiment. A contacting surface area of a needle-side tapered surface 64 is made to be smaller than that of a core-side tapered surface 73. An inner-peripheral surface portion 641 of the needle-side tapered surface 64, which is connected to a recessed portion 611, is brought into contact with the core-side tapered surface 73 when the needle 60 is in contact with the movable core 70. An outer-peripheral surface portion 642 of the needle-side tapered surface 64, which is connected to an outer-most wall 631 of a large-diameter portion 63, is brought into contact with the core-side tapered surface 73 when the needle 60 is in contact with the movable core 70.

An outer surface of the movable core 70 is chrome-plated, so that hardness of the movable core 70 is higher than that of the needle 60. When a center axis of the needle 60 is displaced from a center axis of the movable core 70 during operation of the fuel injection valve, the needle 60 may be worn away, because the core-side upper surface of the movable core 70 may be brought into contact with the needle-side tapered surface 64 or the core-side tapered surface 73 is partly brought into contact with the needle-side tapered surface 64.

In the second embodiment, the contacting surface area of the needle-side tapered surface 64 is made smaller than that of the core-side tapered surface 73, so that the inner-peripheral surface portion 641 and the outer-peripheral surface portion 642 of the needle-side tapered surface 64 are brought into contact with the core-side tapered surface 73 at the same time. According to such a structure, it is avoided that an inner peripheral portion or an outer peripheral portion of the core-side tapered surface 73 is brought into contact with the needle-side tapered surface 64. It is, therefore, possible to reduce wear volume of the needle 60.

In addition, even in a case that the needle angle "θ1" is displaced from the core angle "θ2" during a manufacturing process, it is avoided that the inner or the outer peripheral portion of the core-side tapered surface 73 is brought into contact with the needle-side tapered surface 64. Accordingly, not only the wear volume of the needle 60 can be reduced but also robustness of the fuel injection valve can be improved.

Third Embodiment

Figure 7:
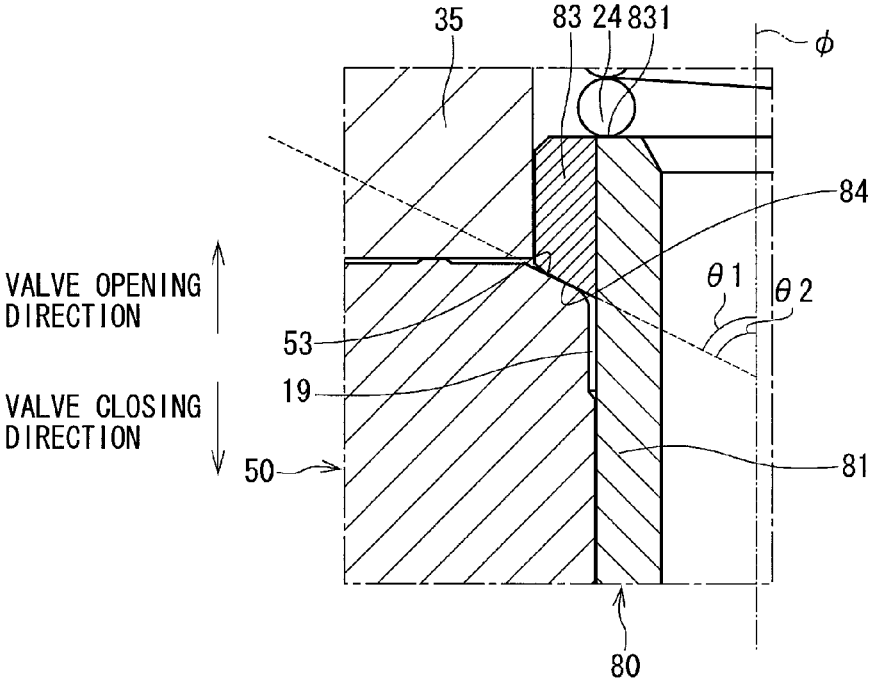
FIG. 7 is a schematic enlarged view showing a relevant portion of a fuel injection valve according to a third embodiment of the present disclosure.

A fuel injection valve of a third embodiment will be explained with reference to FIGS. 7 and 8. The fuel injection valve of the third embodiment is different from that of the first embodiment in a structure of the needle. The same reference numerals are given to those parts, which are the same or similar to those of the first embodiment.

In the third embodiment, a shaft portion 81 of a needle 80 and a large-diameter portion 83 are made as independent parts from each other. As shown in FIG. 7, the large-diameter portion 83 of a ring shape is press-fitted to the shaft portion 81 to thereby form the needle 80. As shown in FIG. 8, a flanged portion extending in a radial inward direction may be formed in the large-diameter portion 83, so that an upper-side surface of the large-diameter portion 83 forms a spring contact surface 831. In the needle 80 of FIG. 7, an upper-side surface of the large-diameter portion 83 and an upper-side surface of the shaft portion 81 form together the spring contact surface 831.

Since the large-diameter portion 83 is made as the independent part from the shaft portion 81, the large-diameter portion can be made of such material having a higher hardness than that of the shaft portion 81. A needle-side tapered surface 84, which is formed at a lower side surface of the large-diameter portion 83, is brought into contact with the core-side tapered surface 53 of the movable core 50.

The movable core 50 is made of such metal having a relatively high hardness. The large-diameter portion 83, which has the needle-side tapered surface 84 to be in contact with the core-side tapered surface 53, can be also made of such metal having the relatively high hardness. As a result, wear volume of the needle 80 can be reduced.

Figure 8:
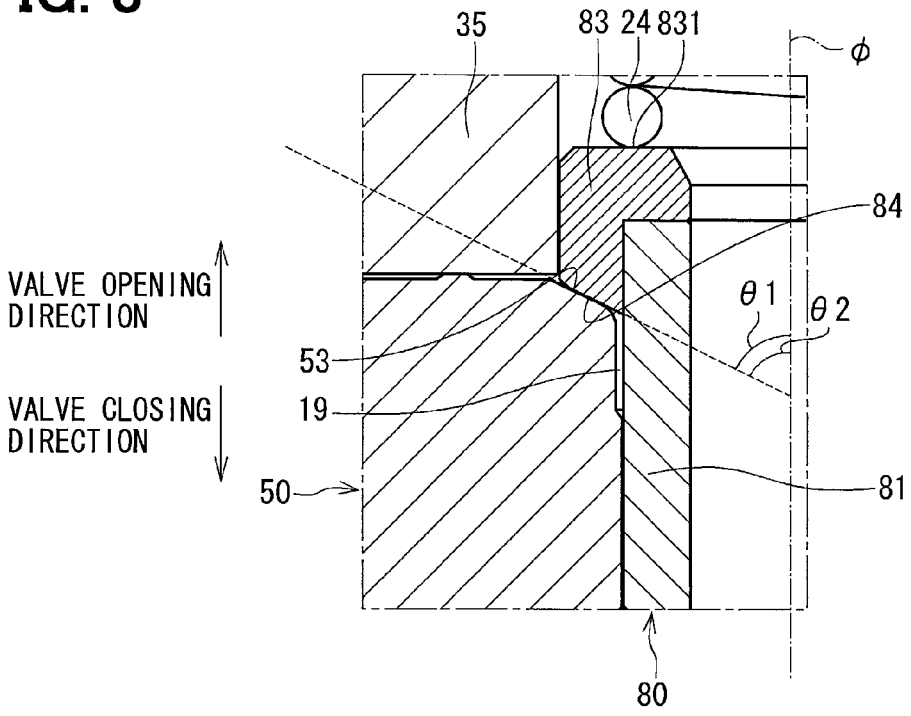
FIG. 8 is a schematic enlarged view showing a relevant portion of a fuel injection valve according to a modification of the third embodiment.

In addition, since the spring contact surface 831 of the large-diameter portion 83 can be likewise made of the metal having the high hardness, in case of the modification shown in FIG. 8, a deformation of the needle 80 which may be caused by the biasing force of the spring 24 can be avoided.

Further Embodiments and/or Modifications (a) In the above embodiments, each of the needle angle "θ1" and the core angle "θ2" is designed to be a value between 45° and 85°, both inclusive. The needle angle and the core angle should not be limited to the above value. The needle angle and the core angle may be smaller than 45° or larger than 85° but smaller than 90°.

(b) In the first embodiment, the damping chamber is formed by the needle-side recessed portion and the core-side recessed portion. In the third embodiment, the damping chamber is formed by the core-side recessed portion. The damping chamber may be formed by a recessed portion, which is formed only on the outer wall of the shaft portion.

(c) In the above embodiments, the damping chamber is formed between the needle and the movable core. However, the it is not always necessary to form the damping chamber.

Figure 9:
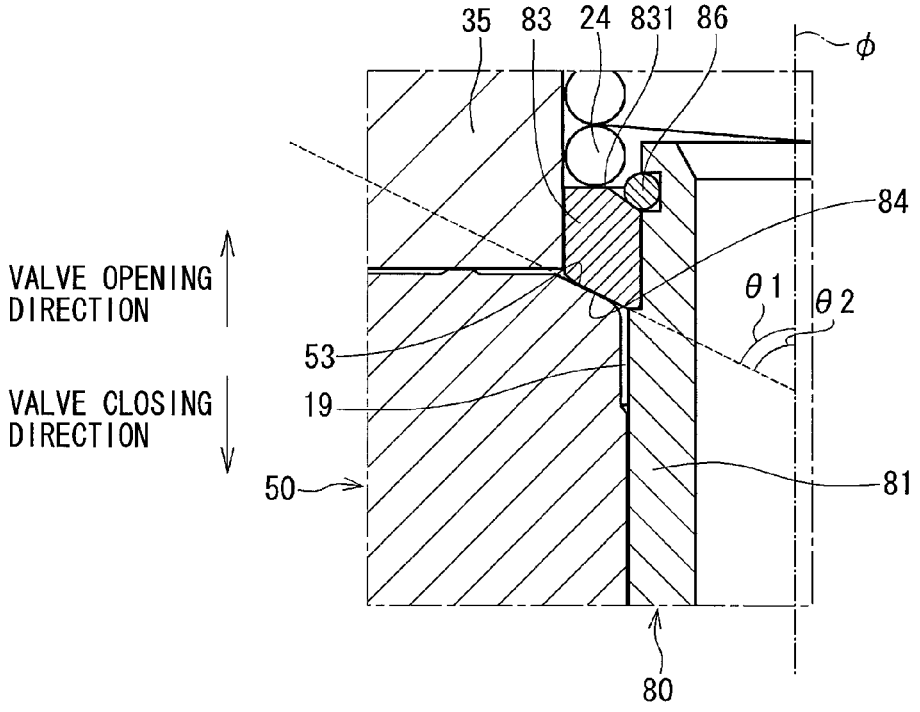
FIG. 9 is a schematic enlarged view showing a relevant portion of a fuel injection valve according to a modification of the present disclosure.
Figure 10:
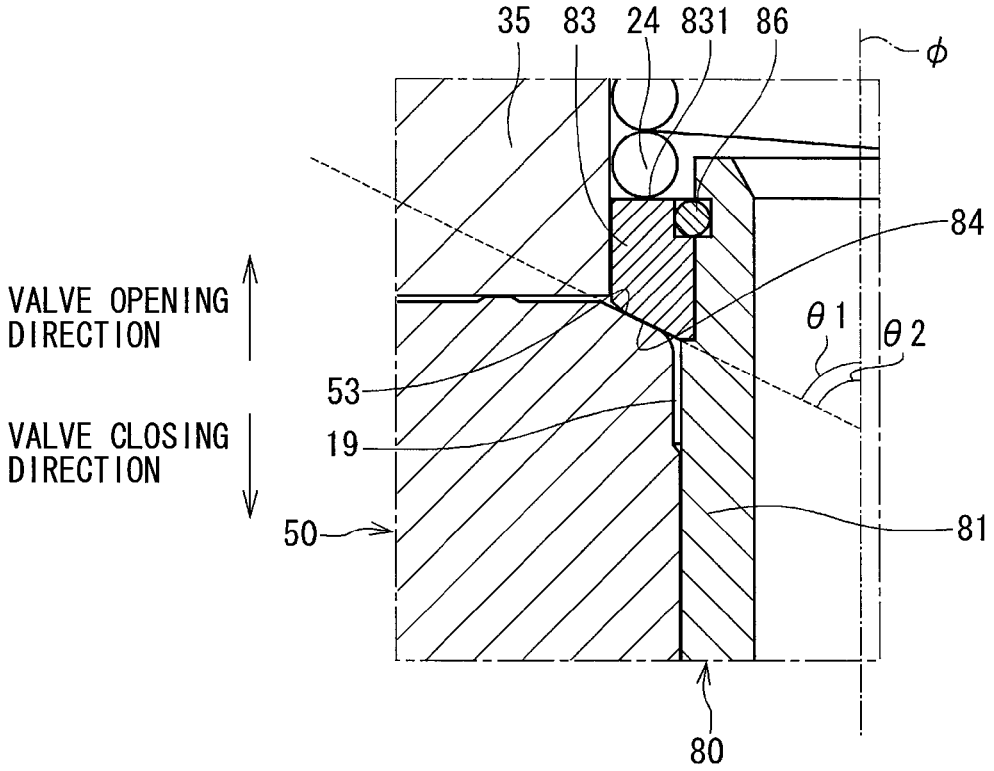
FIG. 10 is a schematic enlarged view showing a relevant portion of a fuel injection valve according to a further modification of the present disclosure.

(d) In the third embodiment, the large-diameter portion is made as the independent part from the needle and the large-diameter portion is press-fitted to the needle. As shown in FIG. 9 or 10, the large-diameter portion 83 can be fixed to the shaft portion 81 not by the press-fitting method but by a c-shape ring 86.

The present disclosure should not be limited to the above embodiments and/or modifications but may be modified in various manners without departing from a spirit of the present disclosure.

What is claimed is:

1. A fuel injection valve comprising:

a cylindrical housing having an injection port formed at one axial end of the housing for injecting fuel, a valve seat formed adjacent to the injection port, and a fuel passage for passing the fuel to the injection port;

a needle movably accommodated in the housing so as to reciprocate in an axial direction thereof, the needle having a shaft portion of a cylindrical rod shape, the needle having a sealing portion at one axial end of the shaft portion on a side to the valve seat, the needle having a large-diameter portion at the other axial end of the shaft portion on an opposite side to the valve seat, the large-diameter portion being integrally formed with the needle so that the large-diameter portion and the needle are movable as one unit, the large-diameter portion having an outer diameter larger than that of the shaft portion, the needle having a needle-side tapered surface inclined by a needle angle with respect to a center axis of the needle, the needle-side tapered surface being formed at an axial-side surface of the large-diameter portion on a side of a valve closing direction, the injection port being opened or closed when the sealing portion is separated from or seated on the valve seat;

a solenoid coil for generating a magnetic field when electric power is supplied thereto;

a fixed core fixed to an inside of the housing and arranged in a magnetic circuit generated by the solenoid coil;

a movable core formed as a separate part from the needle and movably accommodated in the housing on a side of the fixed core to the valve seat, the movable core having a core-side tapered surface inclined by a core angle with respect to the center axis of the needle, the core-side tapered surface being brought into contact with the needle-side tapered surface, and the movable core reciprocating in the axial direction of the housing together with the needle;

a first biasing member for biasing the needle in a valve closing direction; and a second biasing member for biasing the movable core in a valve opening direction, wherein the needle angle and the core angle are identical to each other, so that the needle side tapered surface and the core side tapered surface are in face to face contact with each other, and wherein the center axis of the needle is in the axial direction, such that the center axis of the needle is a center axis of the cylindrical rod shape of the shaft portion in the axial direction.

2. The fuel injection valve according to claim 1, wherein the needle angle is equal to or larger than 45°.

3. The fuel injection valve according to claim 1, wherein the needle angle is equal to or smaller than 85°.

4. The fuel injection valve according to claim 1, wherein the movable core has a through-hole, through which the needle is movably inserted, and a recessed portion is formed at an outer wall of the shaft portion of the needle and/or an inner wall of the movable core, to form a damping chamber into which the fuel flows from the fuel passage or from which the fuel flows out to the fuel passage.

5. The fuel injection valve according to claim 1, wherein a contacting surface area of the needle-side tapered surface is smaller than the surface area of the core-side tapered surface.

6. The fuel injection valve according to claim 5, wherein an inner-peripheral surface portion of the needle-side tapered surface and an outer-peripheral surface portion of the needle-side tapered surface are brought into contact with the core-side tapered surface at the same time, when the needle is in contact with the movable core.

7. The fuel injection valve according to claim 1, wherein the large-diameter portion is made as an independent part from the shaft portion of the needle and fixed to the shaft portion so that the large-diameter portion is movable together with the needle as one unit.

* * * * *